US009904217B1

(12) United States Patent
Takagi

(10) Patent No.: US 9,904,217 B1
(45) Date of Patent: Feb. 27, 2018

(54) FIXING DEVICE AND IMAGE FORMING APPARATUS

(71) Applicants: KABUSHIKI KAISHA TOSHIBA, Tokyo (JP); TOSHIBA TEC KABUSHIKI KAISHA, Tokyo (JP)

(72) Inventor: Osamu Takagi, Chofu Tokyo (JP)

(73) Assignees: KABUSHIKI KAISHA TOSHIBA, Tokyo (JP); TOSHIBA TEC KABUSHIKI KAISHA, Tokyo (JP)

( * ) Notice: Subject to any disclaimer, the term of this patent is extended or adjusted under 35 U.S.C. 154(b) by 0 days.

(21) Appl. No.: 15/250,552

(22) Filed: Aug. 29, 2016

(51) Int. Cl.
*G03G 15/20* (2006.01)

(52) U.S. Cl.
CPC ..... *G03G 15/2039* (2013.01)

(58) Field of Classification Search
CPC ..... G03G 15/2039; G03G 15/2078; G03G 15/2053
USPC ..... 399/69
See application file for complete search history.

(56) References Cited

U.S. PATENT DOCUMENTS

| | | | | |
|---|---|---|---|---|
| 5,495,275 | A * | 2/1996 | Martinengo | B41J 11/002 346/25 |
| 9,244,411 | B2 | 1/2016 | Seshita et al. | |
| 2011/0123213 | A1* | 5/2011 | Yoda | G03G 15/2039 399/69 |
| 2013/0108300 | A1* | 5/2013 | Fujii | G03G 15/2042 399/69 |
| 2014/0227001 | A1* | 8/2014 | Kishi | G03G 15/2042 399/69 |

* cited by examiner

*Primary Examiner* — Sandra Brase
(74) *Attorney, Agent, or Firm* — Patterson & Sheridan, LLP

(57) ABSTRACT

A fixing device includes a plurality of heating members, a press roller, and an intermediate temperature control unit. The plurality of heating members are each in contact with an inside of a rotating body. The rotating body also has a width which is equal to or greater than a width of a recording medium to be printed. The intermediate temperature control unit has a medium width detecting unit configured to detect a width of the recording medium and a print width detecting unit configured to detect a print width of recording data and control a portion of the heating member corresponding to an intermediate heating area. The intermediate heating area is maintained at a set intermediate temperature which is lower than a set temperature of a printing heating area.

20 Claims, 8 Drawing Sheets

FIXING DEVICE AND IMAGE FORMING APPARATUS

FIELD

Embodiments described herein generally relate to a fixing device and an image forming apparatus.

BACKGROUND

Generally, a fixing device mounted in an image forming apparatus employs a lamp that emits infrared rays, e.g., a halogen lamp, as a heat source, or employs a method of heating with Joule heat by electromagnetic induction.

In general, fixing devices include a heating roller or a fixing belt coupled to a plurality of rollers and a press roller. It is necessary to reduce the heat capacity of each component as much as possible and to further concentrate heating areas of the fixing device in order to maximize overall thermal efficiency.

Furthermore, typical heating widths are wide, thus making it difficult to intensively provide widely distributed thermal energy to a nip portion.

In addition, fixing quality within the fixing device for an electronic photograph is affected if heat generated unevenness is present in a paper transport direction and in a perpendicular direction thereto. Particularly, with respect to color printing, heating unevenness produces differences in color developing and can generate a gloss-like appearance.

Additionally, in a fixing device in which heat capacity is extremely reduced, additional problems with respect to speed irregularity, warp or deterioration of the belt, and/or expansion of the transport roller exist in that the temperature of parts of the fixing device through which paper does not pass is increased dramatically. Due to energy conservation concerns, heating of such areas is not preferable. As such, due to environmental concerns, an apparatus or method that provides energy to the nip portion which heats only the passing area of the paper or the image forming area in the paper has become an area of focus in the field.

Furthermore, the area adjacent to the image forming area (referred to as an intermediate area) and the area inside the lateral width of the paper is in contact with the image forming area. As such, the heating of such areas affects the heating of the image forming area and the like. It is preferable that the intermediate heating area should have a low temperature in order to conserve energy, but the paper is heated during printing, and the paper typically expands and contracts due to heat. Differences in temperature at the border of the paper result in wrinkling. In addition, a diameter of the press roller (for pressing the paper from a rear surface thereof) changes depending on the temperature. Accordingly, the border between the intermediate area and the image forming area has an uneven shape thus reducing the overall print quality of the paper.

DETAILED DESCRIPTION

Embodiments disclosed herein generally relate to a fixing device that includes a plurality of heating members, a press roller, and an intermediate temperature control unit. The plurality of heating members are each in contact with an inside of a rotating body. The rotating body has an endless shape and extends in a direction perpendicular to a direction of rotation of the rotating body. The rotating body also has a width which is equal to or greater than a width of a recording medium to be printed. The press roller is disposed on an outside of the rotating body and corresponds to the plurality of heating members. The press roller is configured to be in pressure contact with the recording medium. The recording medium is configured to pass between the rotating body and the press roller. The intermediate temperature control unit has a medium width detecting unit configured to detect a width of the recording medium and a print width detecting unit configured to detect a print width of recording data. The intermediate temperature control unit is configured to compare the width of the recording medium detected by the medium width detecting unit and the print width of the recording data detected by the print width detecting unit. The intermediate temperature control unit is further configured to control a portion of the heating member corresponding to an intermediate heating area positioned inside an area of the recording medium and outside a recording data area. The intermediate heating area is maintained at a set intermediate temperature which is lower than a set temperature of a printing heating area.

Figure 1:
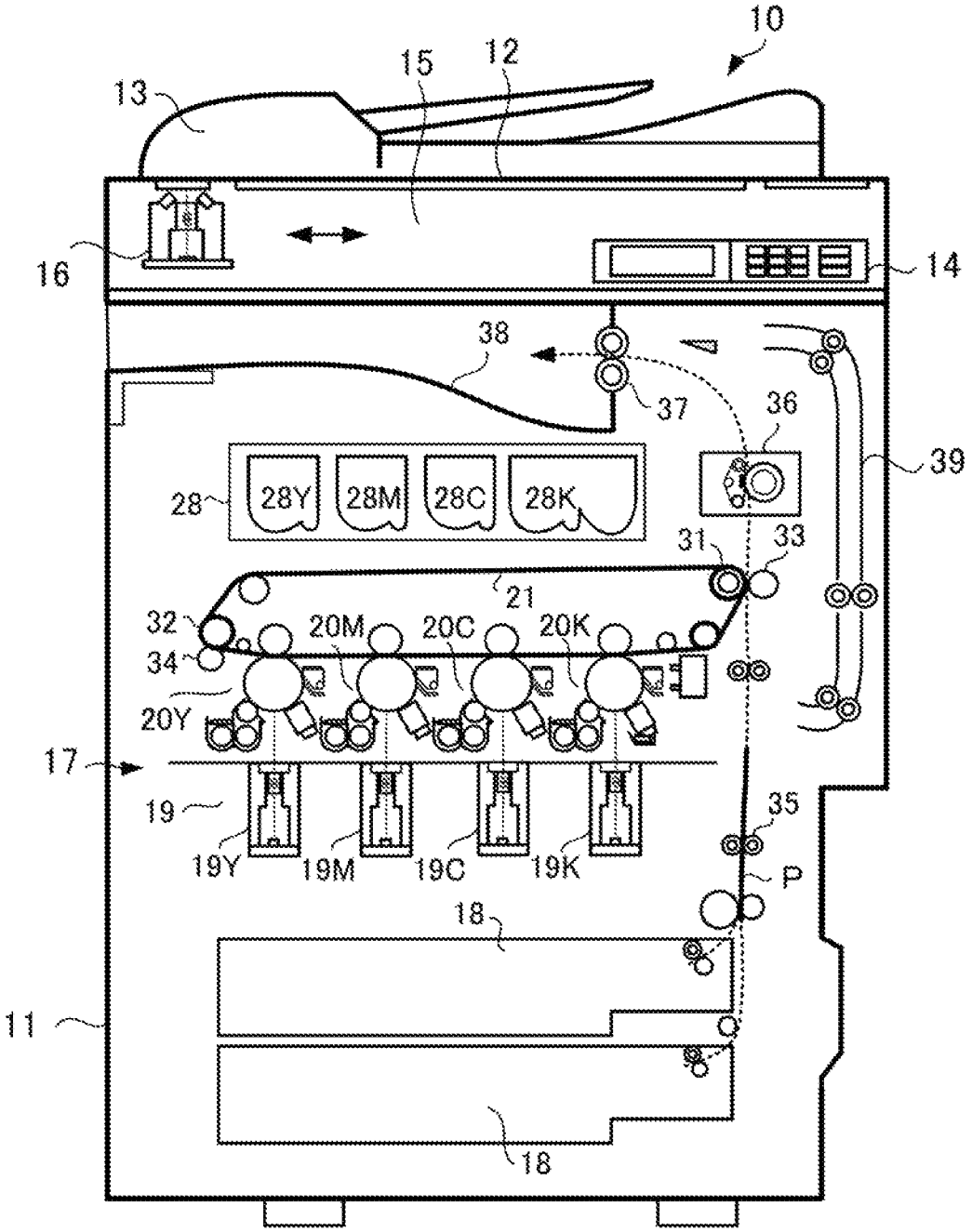
FIG. 1 is a schematic side view of an image forming apparatus having a fixing device, according to one embodiment described herein.

FIG. 1 is a schematic view of an image forming apparatus having a fixing device, according to one embodiment. In some embodiments, the image forming apparatus 10 is, for example, a multi-function peripheral (MFP). The MFP may be a multi-function machine, a printer, a copying machine, or the like. Hereinafter, by way of example only, the MFP will be described.

A document table 12 includes a transparent glass material disposed on an upper portion of a main body 11 of the MFP 10 and an automatic document feeder (ADF) 13 is provided on the document table 12 in an openable and closable manner. In addition, an operating panel 14 is disposed on the upper portion of the main body 11. The operating panel 14 includes various keys and a display unit. In some embodiments, the display unit may be a touch panel display unit.

A scanner unit 15 which is a reading device is disposed in the lower portion of the ADF 13 and within the main body 11. The scanner unit 15 is a unit which generates image data by reading a document sent by the ADF 13 or a document disposed on the document table. Furthermore, the scanner unit 15 includes a contact-type image sensor 16 (hereinafter, simply referred to as the image sensor 16). The image sensor 16 is oriented in the main scanning direction (See, FIG. 1, in the depth direction).

Once an image of a document is placed on the document table 12, the image sensor 16 reads the document image line by line while moving along the document table 12. Each page of the document is read by the image sensor regardless of document size. Furthermore, the image sensor 16 is in a specific position (illustrated position) for reading the image of the document sent by the ADF 13.

In addition, a printer unit 17 is provided in a center portion of the main body 11, and a plurality of paper feed cassettes 18 in which various sizes of paper P are accepted are provided in a lower portion of the main body 11. The printer unit 17 includes a photosensitive drum for each color and a scanner head 19. The scanner head 19 includes an LED therein as a light exposing device. The image is generated by scanning the photosensitive drum with light from the scanner head 19.

The printer unit 17 generates the image on paper (e.g., a recording medium) by processing image data read by the scanner unit 15 as well as image data generated by a personal computer, or other similar device. In some embodiments, the printer unit 17 is a color laser printer, for example, a tandem system. The printer unit 17 includes image forming units 20Y, 20M, 20C, and 20K having yellow (Y), magenta (M), cyan (C), and black (K) colors, respectively. The image forming units 20Y, 20M, 20C, and 20K are placed in a lower side of an intermediate transfer belt 21 in parallel along a downstream side from the upstream side. In addition, the scanner head 19 also includes a plurality of scanner heads 19Y, 19M, 19C, and 19K corresponding to the respective image forming units 20Y, 20M, 20C, and 20K.

Construction of the Image Forming Unit

Figure 2:
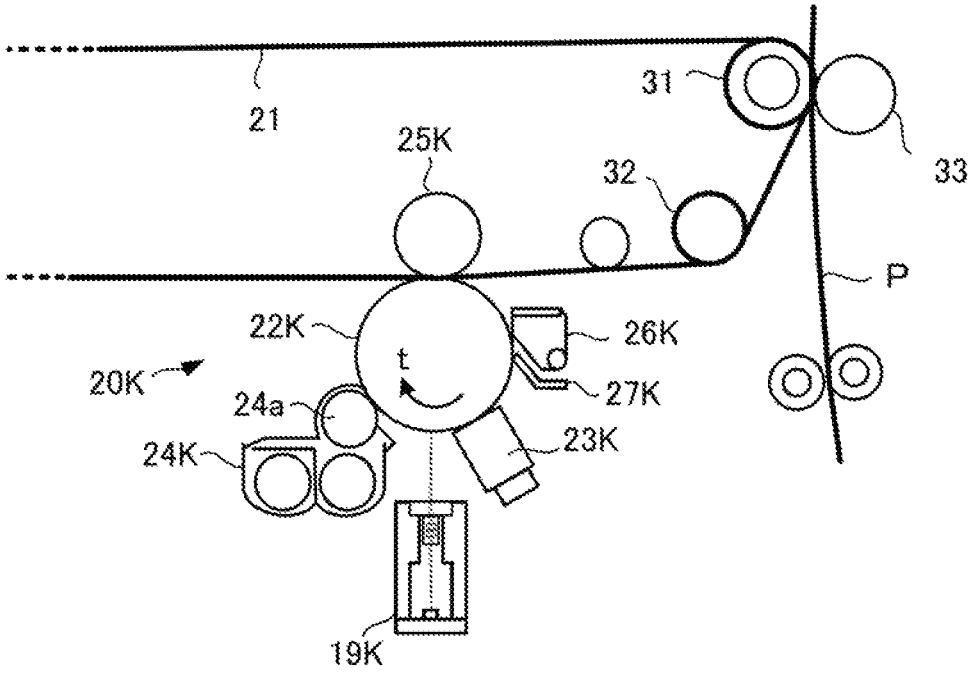
FIG. 2 is an enlarged schematic view of a portion of the image forming unit of FIG. 1.

FIG. 2 is an enlarged schematic view of a portion of the image forming unit of FIG. 1. FIG. 2 illustrates the image forming unit 20K of the image forming units 20Y, 20M, 20C, and 20K. Furthermore, since each of the image forming units 20Y, 20M, 20C, and 20K has the same, or similar, construction with each other, only the image forming unit 20K is described herein, as an example.

The image forming unit 20K includes a photosensitive drum 22K. In some embodiments, the photosensitive drum 22K may be an image carrier. A charger 23K, a developing unit 24K, a primary transfer roller (transfer unit) 25K, a cleaner 26K, and a blade 27K, or the like, is arranged around the photosensitive drum 22K along the rotational direction t. An electrostatic latent image is formed on the photosensitive drum 22K in the light exposing position of the photosensitive drum 22K by being irradiated with light from the scanner head 19K.

The charger 23K of the image forming unit 20K uniformly charges the surface of the photosensitive drum 22K. The developing unit 24K supplies two-component developer containing a black toner and the carrier to the photosensitive drum 22K, using the developing roller 24*a* to which a developing bias is applied and, thus, the electrostatic latent image is developed. The cleaner 26K removes residual toner on the surface of the photosensitive drum 22K using the blade 27K.

In addition, as illustrated in FIG. 1, a toner cartridge 28 that supplies toner to the developing units 24Y to 24K is provided on the upper portion of the image forming units 20Y to 20K. The toner cartridge 28 includes toner cartridges 28Y, 28M, 28C, and 28K having yellow (Y), magenta (M), cyan (C), black (K) colors, respectively.

The intermediate transfer belt 21 moves cyclically. The intermediate transfer belt 21 is stretched across the driving roller 31 and the driven roller 32. In addition, the intermediate transfer belt 21 is in contact so as to face the photosensitive drums 22Y to 22K. In a position facing the photosensitive drum 22K of the intermediate transfer belt 21, a primary transfer voltage is applied by a primary transfer roller 25K and thus a toner image on the photosensitive drum 22K is primarily transferred to the intermediate transfer belt 21.

A secondary transfer roller 33 is disposed to face the driving roller 31 which stretches the intermediate transfer belt 21. When the paper P passes between the driving roller 31 and the secondary transfer roller 33, a secondary transfer voltage is applied to the paper P by the secondary transfer roller 33. Then, the toner which is transferred to the intermediate transfer belt 21 is secondarily transferred to the paper P. A belt cleaner 34 is disposed in the vicinity of the driven roller 32 of the intermediate transfer belt 21. In some embodiments, the belt cleaner 34 is disposed adjacent the driven roller 32 of the intermediate transfer belt 21.

In addition, as illustrated in FIG. 1, a paper feed roller 35, by which the paper P is removed from the inside of a paper feed cassette 18, is disposed between the paper feed cassette 18 and the secondary transfer roller 33. Furthermore, a fixing device 36 is provided downstream of the secondary transfer roller 33. In addition, a transport roller 37 is provided downstream of the fixing device 36. The transport roller 37 discharges the paper P to a paper discharging portion 38. Furthermore, a reverse transport path 39 is provided downstream of the fixing device 36. The paper P is reversed and/or guided to a direction of the secondary transfer roller 33 by the reverse transport path 39, thus the reverse transport path is used when performing a duplex printing.

FIGS. 1 and 2 are views illustrating an example of one embodiment, however, a structure of the image forming apparatus portion, in addition to the fixing device 36, is not limited to the structure shown in FIGS. 1 and 2.

Control System in One Embodiment

Figure 3:
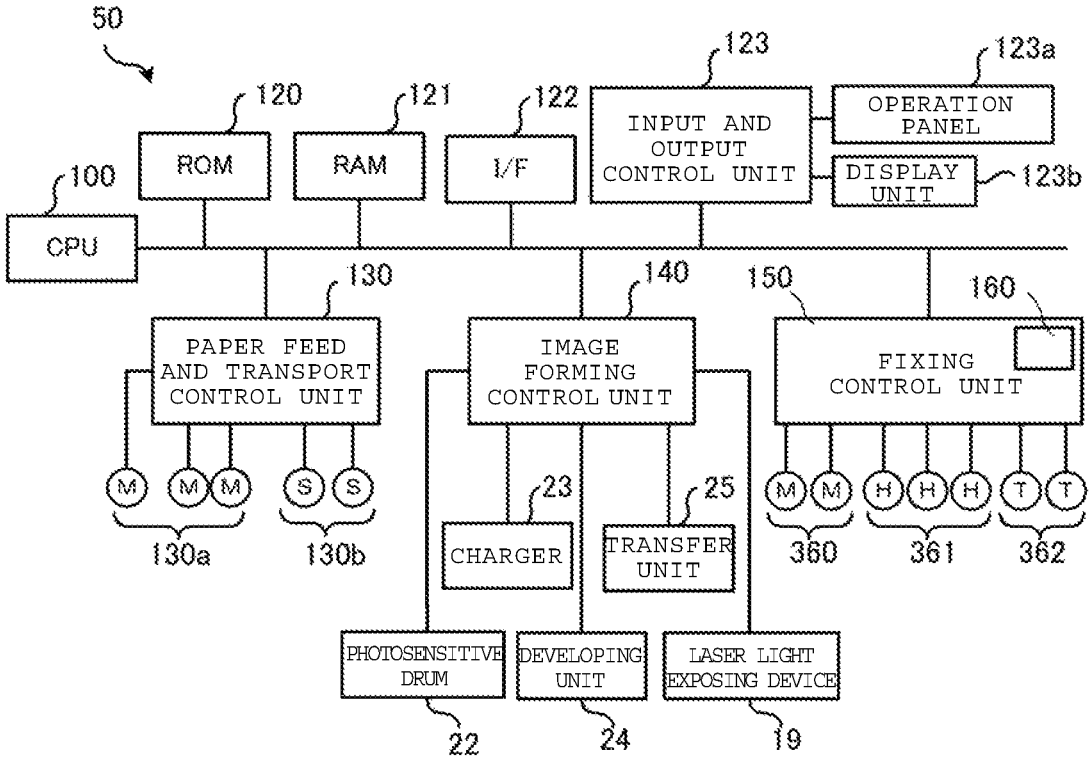
FIG. 3 is a schematic block diagram of a control system of an MFP, according to one embodiment described herein.

FIG. 3 is a schematic block diagram illustrating a control system 50 of an MFP 10, according to one embodiment. The control system 50 includes, for example, a CPU 100 controlling the whole MFP 10, a read only memory (ROM) 120, a random access memory (RAM) 121, an interface (I/F) 122, an input and output control unit 123, a paper feed and transport control unit 130, an image forming control unit 140, and a fixing control unit 150.

The CPU 100 achieves a processing function for image forming by executing a program that is stored in the ROM 120 or the RAM 121. A control program and control data that control a basic operation of the image forming processing are each stored in the ROM 120. The RAM 121 is a working memory.

For example, a control program for the image forming unit 20, the fixing device 36, or the like and various types of control data used by the control program are stored in the ROM 120 (or the RAM 121). As a specific example of the control data, according to the present embodiment, there is a corresponding relationship between a size of a printing area on the paper (a width in a main scanning direction) and a heating member which is a power supplying target, or the like.

The I/F 122 communicates with various devices, such as a user terminal or a facsimile. The input and output control unit 123 controls an operation panel 123*a* and/or a display unit 123*b*. The paper feed and transport control unit 130 controls a motor group 130*a*, or the like, wherein the motor group 130*a* drives the paper feed roller 35, the transport roller 37 of the transport path, or the like.

The paper feed and transport control unit 130 controls the motor group 130*a*, or the like, by receiving and/or analyzing the detecting result of various sensors 130*b*. The various sensors 130*b* may be disposed on or near the transport path or the paper feed cassette 18. In some embodiments, the result of the various sensors 130*b* may be determined based on the control signal received from the CPU 100. The image forming control unit 140 control the photosensitive drum 22, the charger 23, the laser light exposing device 19, a developing unit 24, or a transfer unit 25 based on the control signal received from the CPU 100.

The fixing control unit 150 controls the driving motor 360, the heating member 361, a temperature detecting member 362, such as a thermistor, based on the control signal received from the CPU 100. The fixing device 36 illustrated in FIG. 1 is controlled by the fixing control unit 150 illustrated in FIG. 3. A fixing temperature control unit 160 is included in the fixing control unit 150. Hereinafter, a construction and an operation of the fixing temperature control unit 160 is described.

Description of the Fixing Principle

Figure 4:
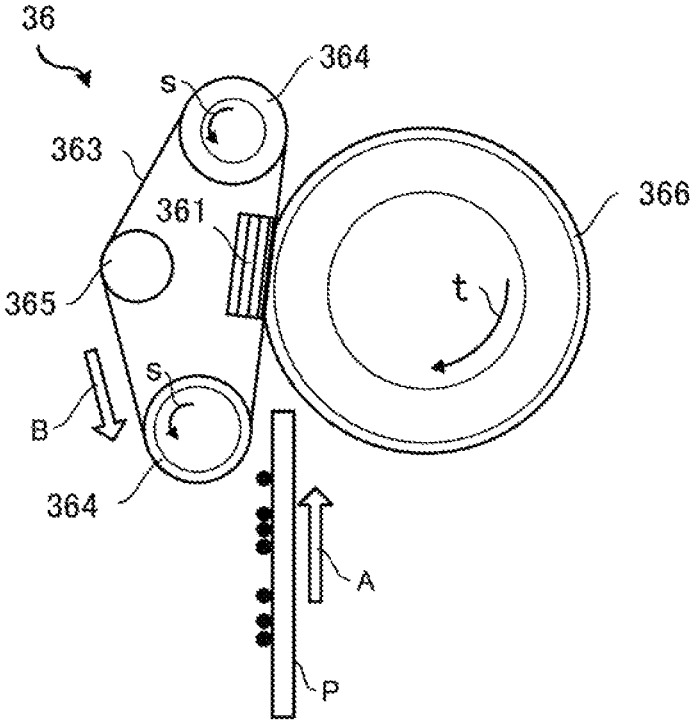
FIG. 4 is a schematic side view of a fixing mechanism of the fixing device of FIG. 1, according to one embodiment described herein.

FIG. 4 illustrates a side view of the fixing device 36 of FIG. 1. As shown, the fixing device 36 includes a plate shaped heating member 361, an endless belt 363 that has an elastic layer which is stretched by a plurality of rollers, a belt transport roller 364 that drives the endless belt 363, a tension roller 365 that applies tension to the endless belt 363, and a press roller 366 that has a surface on which an elastic layer is formed.

The endless belt 363 is moved in the direction denoted "B" by a belt transport roller 364 operatively connected to a drive motor being rotated in the direction denoted "S". The heat generating side of the heating member 361 is in contact with the inside of the endless belt 363 and, subsequently the heating member 361 is pressed in the direction of the press roller 366. As such, the heating member 361 forms a fixing nip having a predetermined width between the endless belt 363 and the press roller 366 by a press force. The paper P on which toner is attached is inserted between a portion of the endless belt 363 and the press roller 366 from the direction denoted "A", the portion of the endless belt 363 being an inside of the belt with which the heating member is in contact. The toner attaches to and/or with the endless belt 363 side and is fixed to the paper P by being melted by the heat generated from the heating member 361.

The endless belt 363 includes a silicone rubber layer with a thickness of 200 μm is formed on the outer side of a Nickel or SUS (which is a type of stainless steel) base material with a thickness of 50 μm or a polyimide which is a heat-resistant resin with a thickness of 70 μm, for example. The outermost periphery of the endless belt is coated with a surface protective layer such as a PFA (perfluoroalkoxy). The press roller 366, for example, has a silicone sponge layer with a thickness of 5 mm on a steel rod surface of ϕ10 mm, and the outermost periphery thereof is coated with a surface protective layer such as the PFA.

In addition, a glaze layer and/or a heat generating resistive layer are directly stacked on an insulating body, such as a ceramic substrate, in the heating member 361. The heat generating resistive layer is made of, for example, a material such as $TaSiO_2$. Furthermore, a surface layer may be provided on the heat generating resistive layer.

A method of forming the heat generating resistive layer may be similar to the methods of making a thermal head. The method includes forming an aluminum masking layer on the heat generating resistive layer. Insulation is disposed between adjacent heating members, and, in some embodiments, an aluminum layer is formed in a pattern in which the heating member is exposed in a paper transport direction.

In some embodiments, the heating member may be a resistive heating body. The supplying of power to the heating member may be achieved by being connected from an aluminum layer (for example, an electrode) of both end portions thereof to a conductor via wiring. Furthermore, both end portions of the conductor may be connected to switching elements of the switching driver IC.

Furthermore, in order to cover all of the heat generating resistive layer, the aluminum layer, the wiring, or the like, may have a thin layer ceramic formed on the upper portion thereof. A protective layer may be formed on the top portion thereof. The protective layer is formed of, for example, $Si_3N_4$ or the like. If AC or DC is supplied to a heating resistor group that constitutes the heating member, portions in which heat is generated by a triac or a FET is supplied power at zero-cross to prevent and/or account for flicker.

Furthermore, in some embodiments, a line sensor (not illustrated) may be placed in the paper passing area, thus making it is possible to determine the size and/or position of the paper to be passed through in real time. The line sensor may be configured to determine the paper width from the image data or the information of the paper feed cassette 18 in which a medium (the paper) is stored in the MFP 10 at the time of a print operation is started.

Figure 5:
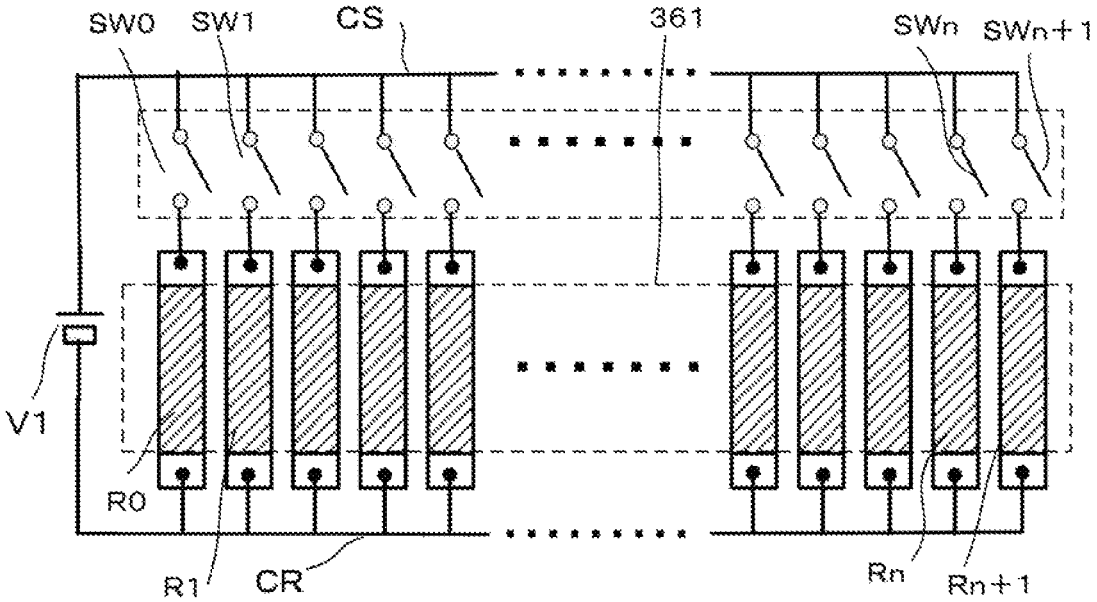
FIG. 5 is a schematic view of a heating member, a switching group, and an electrical circuit of a power source, according to one embodiment described herein.

Description of the Relationship Between the Heating Member and Other Configurations of the Temperature Control Unit, and Operations Thereof FIG. 5 schematically illustrates the relationship of the heating member 361, the switches SW0 to SWn+1, and the electrical circuit of the power supply, according to one embodiment. The heating member 361 includes a plurality of heating resistors R1 to Rn operatively connected in parallel with each other. Each of the switches SW1 to SWn is connected to each of the heating resistors R1 to Rn at a first end and a second end of the switches SW1 to SWn are shared. Additionally, the second ends of the heating resistors R1 to Rn are operatively connected to one another. A DC power supply V1 is further operatively connected between the shared connection ends CS and CR.

The switches SW1 to SWn change the temperature of the heating resistors operatively connected to the switches by changing a switching frequency of the switches SW1 to SWn. Specifically, the switch corresponding to the heating resistor of the printing area is switched by a predetermined switching frequency fp which corresponds to a set temperature Tp of the printing area. Additionally, the switch corresponding to the heating resistor of the intermediate heating area is switched by a predetermined switching frequency fm which corresponds to the set temperature Tm of the intermediate heating area.

Figure 6:
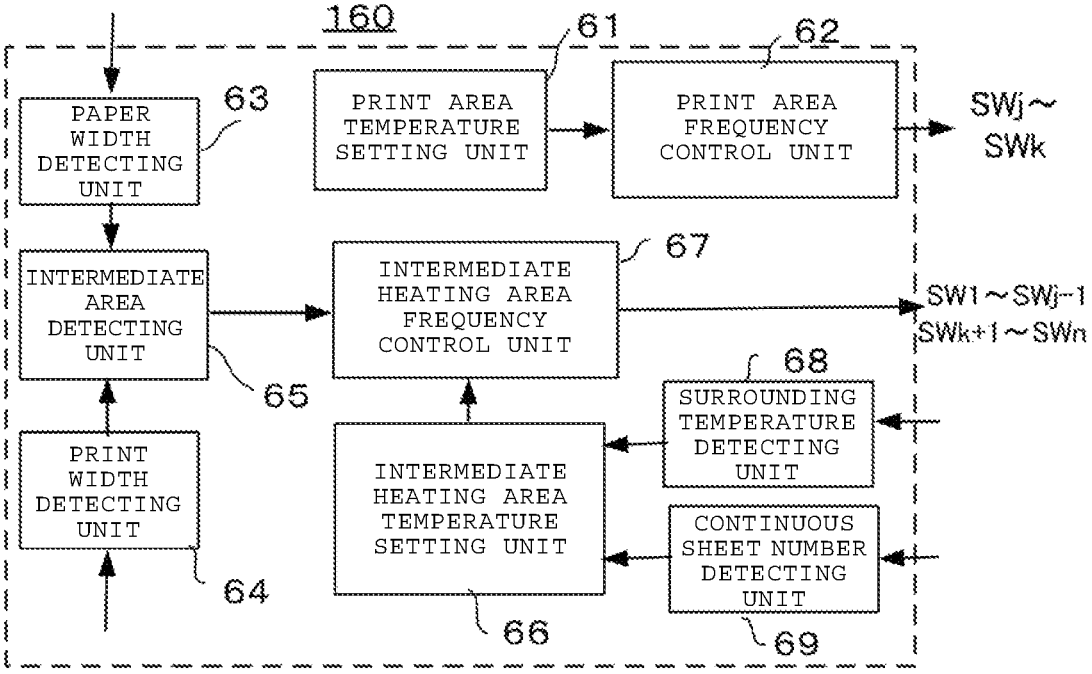
FIG. 6 is a schematic view of a fixing temperature control unit, according to one embodiment described herein.

FIG. 6 schematically illustrates one embodiment of the fixing temperature control unit 160. The fixing temperature control unit 160 includes a printing area temperature setting unit 61 that sets a temperature of the printing area and a printing area frequency control unit 62 that controls so that the switch corresponding to the printing area such that the switch is switched by the switching frequency fp corresponding to the set printing area temperature Tp. The fixing temperature setting unit 61 also includes a paper width detecting unit 63 that detects a width of the paper to be printed, a print width detecting unit 64 that detects an actual print width of the print paper, an intermediate heating area detecting unit 65 that detects an intermediate heating area which is not printed from the detected paper width and the print width, an intermediate heating area temperature setting unit 66 that sets a temperature Tm of the intermediate heating area, an intermediate heating area frequency control unit 67 that controls a switch of the intermediate heating area such that the switch is switched by the switching frequency fm corresponding to the intermediate heating area temperature Tm, a surrounding temperature detecting unit 68 that detects a surrounding temperature, and a continuous sheet number detecting unit 69 that detects a sheet number to be printed continuously.

The intermediate heating area set temperature Tm set by the intermediate heating area temperature setting unit 66 varies slightly up and down in accordance with the temperature detected by the surrounding temperature detecting unit 68 and continuous sheet number detected by the continuous sheet number detecting unit 69.

The paper width detecting unit 63 detects the width of the paper to be printed. For example, if the paper feed cassette 18 is selectively used depending on the size of the paper, the width of the paper can be detected by detecting the paper feed cassette 18 from which the paper is transported and receiving a signal thereof in the paper width detecting unit 63.

Additionally, and by way of example only, the maximum print width of one page may be utilized as the print width detected in the print width detecting unit 64. Typically, the dimension of the print width is determined in each document to be printed. However, the size and/or dimension of the document to be printed may be altered depending on the size of the lines of the print. However, the maximum print width for each page may be determined if the thermal conductivity is relatively slow and the heating width for each line is changed, as the appropriate heating cannot be performed.

The specific print width may be detected in the image forming control unit 140. If the document is scanned and the image is read in the MFP 10, the specific print width may be obtained when the image signal is obtained by the image sensor 16. In addition, if the image signal is received from the outside, it is possible to detect the print width from the image signal. The print width may also be detected when the image is formed in the image forming control unit 140.

Figure 7:
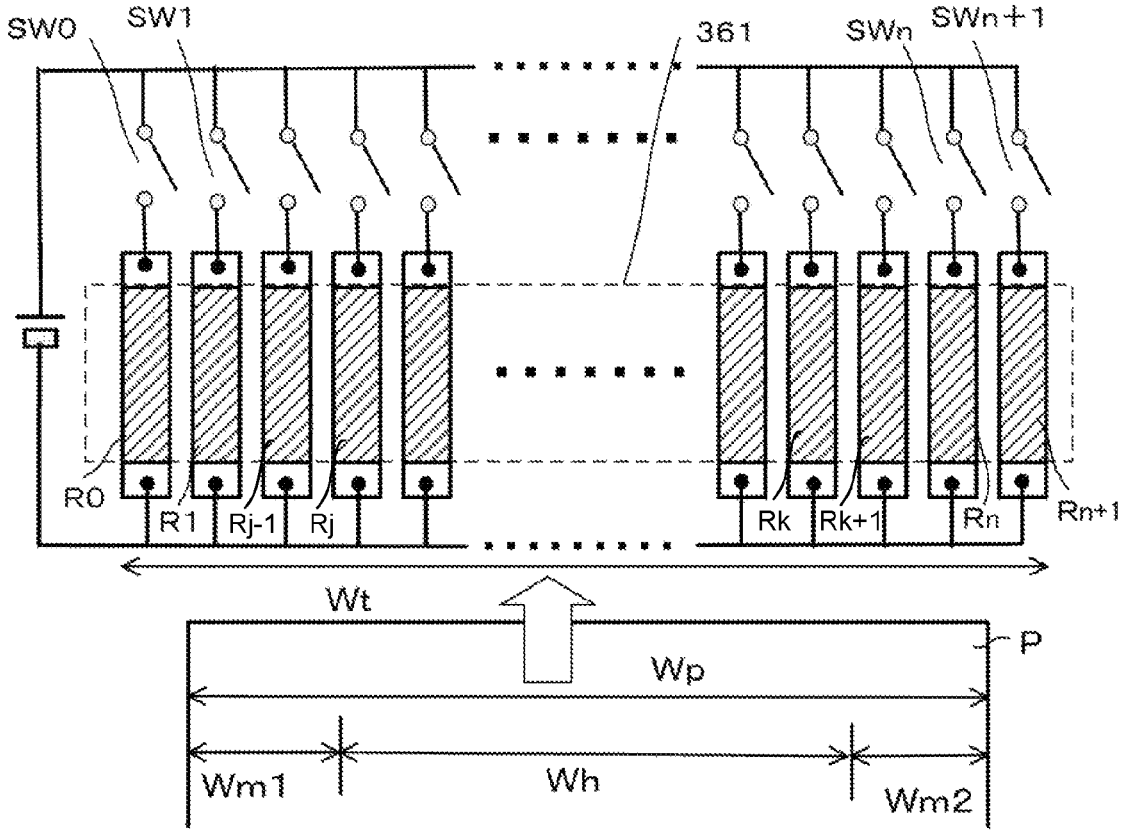
FIG. 7 is a schematic view of a relationship of the heating member and a paper width, a print heating width, and an intermediate heating width, according to one embodiment described herein.

FIG. 7 schematically illustrates the relationship of the arrangement width of the heating resistor, the paper width, the print width, and the heating width of the intermediate heating area (an intermediate heating width). As shown in FIG. 7, the heating resistor arrangement width in which the heating resistors R0 to Rn+1 are arranged is referred to as Wt. Furthermore, the width of the paper to be printed P is referred to as Wp. If the print width of the paper P described above is referred to as Wh, the print width thereof is a print heating width of the heating resistor.

The intermediate heating widths of the intermediate heating area provided on the each side of the printing area of the print width Wh are referred to as Wm1 and Wm2. The paper width Wp is equal to or less than the heating resistor arrangement width Wt as the printing area takes the maximum width of the paper P to be used. In other words, Wp≤Wt.

Additionally, the paper width Wp is the same as the value of the print width Wh added to the intermediate heating width (Wm1+Wm2). In other words, Wh=Wm1+Wm2. The heating resistors which are in a range of the printing area are illustrated in FIG. 7. The heating resistors that correspond to the print width Wh may be denoted Rj to Rk. Accordingly, the heating resistors in the intermediate heating widths is denoted R1 to Rj−1 and Rk+1 to Rn. The switches are referred to as a block because the switches connected to the heating resistors in the intermediate heating width are synchronized and are further opened and closed at exactly the same times.

As further shown in FIG. 6, the heating temperature of the printing area is determined by the printing area temperature setting unit 61, and the printing area frequency control unit 62 controls the opening and closing of the switches SWj to SWk that correspond to the heating resistors Rj to Rk in the area corresponding to the heating temperature, by frequencies corresponding to the temperature Th.

On the other hand, and with respect to the intermediate heating area on both sides of the printing area, the intermediate heating area frequency control unit 67 controls the opening and closing of the switches SW1 to SWj−1, SWk+1 to SWn which correspond to the heating resistors R1 to Rj−1, Rk+1 to Rn by frequencies corresponding to a temperature that is set by the intermediate heating area temperature setting unit 66. In addition, the intermediate set temperature is a lower temperature than a set temperature of a heating area of the printing.

In some embodiments, the heating set temperature of the intermediate heating area (the intermediate heating width Wm1, Wm2) may present a problem. Typically, the intermediate heating area is on the both sides of the heating area. As such, it is possible to differentiate the heating temperatures between the two areas, as each of the heating temperatures of the two areas are the same temperature (Tm1=Tm2=Tm). However, in some cases an intermediate heating area might not be provided on both sides of the heating area, and, in certain embodiments, the intermediate heating area may be provided only on one side of the heating area.

When the heating resistor arrangement width Wt is equal to or less than the width Wp of the maximum size of the paper to be used and paper having a size smaller than the maximum size of allowable paper is used, it may not be necessary to heat the corresponding resistor disposed between the heating resistor arrangement area and the paper width. Accordingly, the switches operatively connected to the heating resistor in this area (an area that needs not to be heated) need not be closed while printing on the paper is performed, and, in some embodiments, may remain in the opened state.

In one example, paper up to size A3 can be accommodated with a heating width of up to 320 mm. As such, 16 heating resistor blocks may be provided, each having heating width of 20 mm, for a total of 320 mm. If each block has a power output of 75 W, total output of the heating resistors is about 1,200 W.

As further shown in FIGS. 6 and 7, the switching of the heating resistors at the time of printing is described. FIG. 6 schematically illustrates the fixing temperature control unit 160 in the fixing control unit 150. FIG. 7 schematically illustrates the relationship of the heating resistor arrangement width and the paper width, the print width, or the like.

The set heating temperature of the printing area may be affected by the surrounding temperature, continuous sheet printing, or the like. However, in order to simplify the description, an example where the heating temperature of the printing area is set to a constant temperature Th which is determined in advance is used. Accordingly, the set temperature output from the printing area temperature setting unit 61 is constant. Additionally, the opening and closing frequencies fh of the switches connected to the resistors Rj to Rk in the printing area are constant in the printing area frequency control unit 62 into which the output of the printing area temperature setting unit 61 is directed.

In such cases, the set temperature Tm of the intermediate heating area has a predetermined initial value Tm0 in the intermediate heating area temperature setting unit 66. If the surrounding temperature is lower than the temperature Tm0, the set temperature Tm of the intermediate heating area is set to a temperature that is higher than the initial set temperature Tm0. Accordingly, the set temperature output from the intermediate heating area temperature setting unit 66 is higher by a temperature delta ΔeT, or in other words the temperature is set to Tm0+ΔeT.

In another case, the surrounding temperature Ta is detected in the surrounding temperature detecting unit 68 and the intermediate heating area temperature setting unit 66 compares the surrounding temperature to a predetermined surrounding set temperature Ts. When the surrounding temperature Ta actually detected in the surrounding temperature detecting unit 68 is lower than the surrounding set temperature, the intermediate heating area temperature setting unit 66 outputs a modified set temperature Tm0+ΔeT to the intermediate heating area frequency control unit 67 and, subsequently, the intermediate heating area frequency control unit 67 controls the opening and/or the closing of the switches SW1 to SWj−1, SWk+1 to SWn operatively connected to the heating resistors R1 to Rj−1, Rk+1 to Rn of the intermediate heating area by the frequency corresponding to the modified set temperature Tm0+ΔeT.

In another case, if the continuous sheet number is greater than the predetermined sheet number, the set temperature is set to a lower temperature than the initial set temperature Tm0. Accordingly, the set temperature output from the intermediate heating area temperature setting unit 66 is lower by a low temperature ΔcT, or in other words the temperature is set to Tm0−ΔcT. The continuous sheet number Ma of the actual printing is detected in the continuous sheet number detecting unit 69. The intermediate heating area temperature setting unit 66 compares the continuous sheet number Ma of the actual printing to the predetermined continuous sheet number Mc. When the continuous sheet number Ma of the printing actually detected in the continuous sheet number detecting unit 69 is greater than the predetermined continuous sheet number Mc, the intermediate heating area temperature setting unit 66 outputs a modified set temperature Tm0−ΔcT to the intermediate heating area frequency control unit 67. Subsequently, the intermediate heating area frequency control unit 67 controls the opening and the closing of the switches SW1 to SWj−1, SWk+1 to SWn operatively connected to the heating resistors R1 to Rj−1, Rk+1 to Rn of the intermediate heating area by the frequency corresponding to the temperature.

As a result, when the surrounding temperature Ta is lower than the predetermined temperature Ts and the printing continuous sheet number Ma is greater than the predetermined continuous sheet number Mc, the intermediate heating area temperature setting unit 66 outputs the temperature Tm0+ΔeT−ΔcT to the intermediate heating area frequency control unit 67 which controls the opening and the closing of the switches SW1 to SW−1, SWk+1 to SWn of the intermediate heating area by the frequency corresponding to the temperature.

Byway of example only, when the opening and the closing of the switches SWj to SWk corresponding to the heating area are controlled using 50 Hz of AC power, the opening and the closing of the switches are controlled at 100 times zero-crossing in a second. The switches SW1 to SWj−1, SWk+1 to SWn corresponding to the intermediate heating area are set so that ΔeT is 2° C. to 3° C., if the surrounding temperature Ta detected is lower than the set temperature Ts=20° C.

Furthermore, when the continuous sheet number Ma detected is more than the predetermined continuous sheet number Mc=50, for example, it is set so that ΔcT=10° C. is subtracted. Also, the difference in temperature between the printing area and the intermediate area is between about 70° C. and about 100° C.

Description of the Operation Using a Flow Chart

Figure 8:
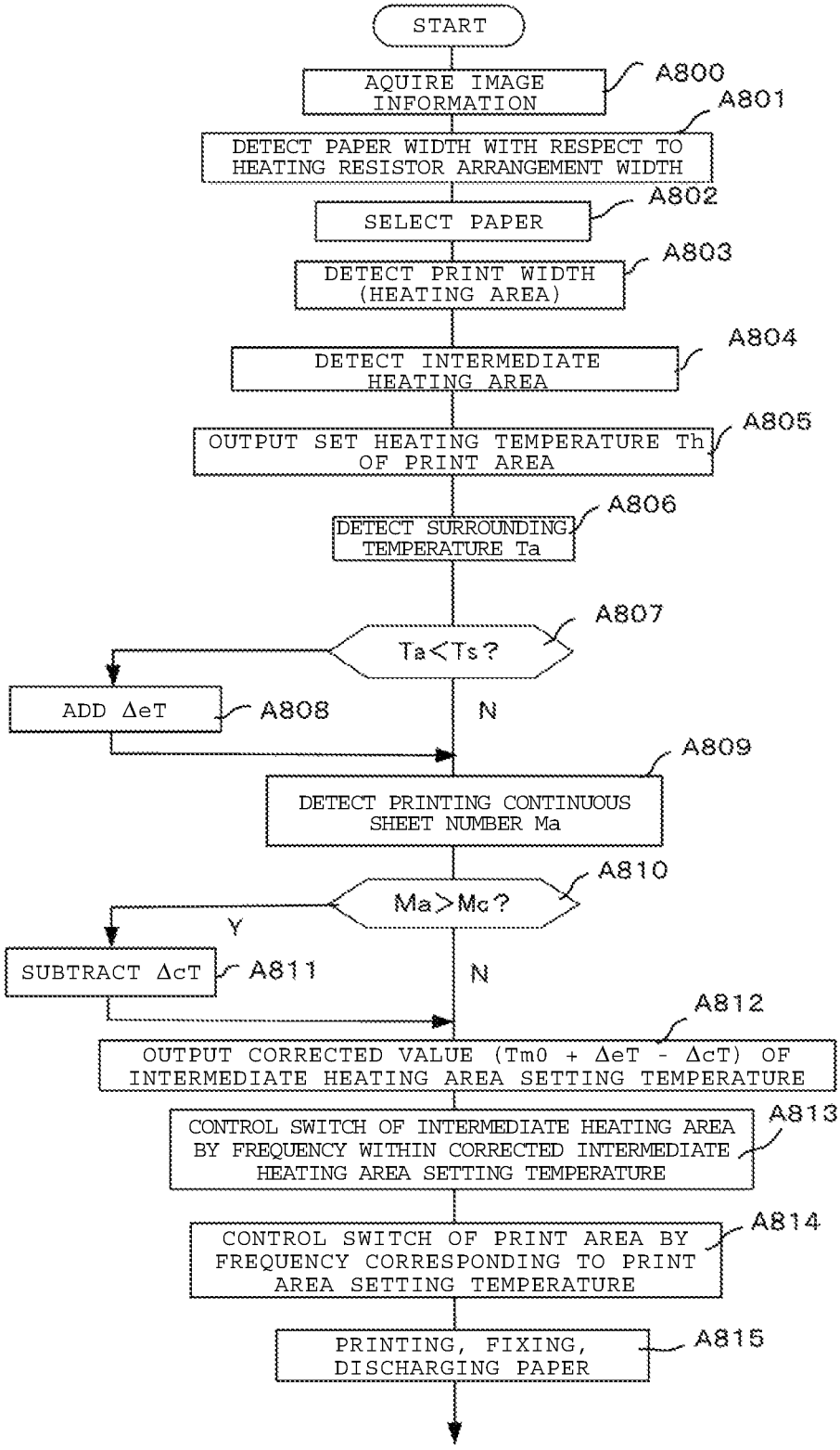
FIG. 8 is a schematic flow diagram illustrating an operation, according to one embodiment described herein.

FIG. 8 schematically illustrates a flow chart for the fixing operation of the toner image of the MFP 10. As shown, processing before the toner is heated and fixed to the paper is referred to as a heating preparation processing.

At operation A800 image information to be printed is acquired. Information including the required size and/or the width of the paper the print width, or the specific actual image data may be included in the image information. At operation A801 the paper width of the required size of paper is detected. At operation A802 the paper to be printed is selected. As such, a signal indicating the required size of the paper is sent to the paper feed and transport control unit 130 (See, FIG. 3) and the paper feed cassettes 18 (according to the size of the paper that is selected).

At operation A803 the print width is detected from the image information at the time of printing the image data. The print width is a width at the time of the printing and is determined by decoding the image data. Oftentimes, however, the print width fluctuates and, in some embodiments, the maximum print width or the average print width of one page may be used. At operation A804, the intermediate heating region is detected as a difference between the paper width and print width.

At operation A805 the printing area temperature setting unit 61 outputs the set heating temperature Th of the predetermined printing area. At operation A806 the surrounding temperature detecting unit 68 detects the surrounding temperature by a temperature sensor provided in the vicinity of the fixing device 36.

At operation A807 the predetermined set temperature Ts is detected in a temperature comparison circuit in the inside of the intermediate heating area temperature setting unit 66 regardless of the surrounding temperature Ta actually measured by the surrounding temperature detecting unit 68. At operation A808, the predetermined temperature delta ΔeT is added to the initial set temperature Tm0 of the intermediate heating area (Tm0+ΔeT) when the surrounding temperature Ta is lower than the set temperature Ts (Ta<Ts). Subsequently, the process proceeds to operation A809.

On the other hand, when the surrounding temperature Ta is equal to or greater than the set temperature Ts (Ta≥Ts), the initial set temperature Tm0 of the intermediate heating area is maintained as it is, and the process proceeds to operation A809.

At operation A809, the printing continuous sheet number is counted via the continuous sheet number detecting unit 69. In some embodiments, the counter is provided in the vicinity of a paper discharging portion 38 discharge port and counts the sheet number printed continuously. The information is input to the intermediate heating area temperature setting unit 66, and at operation A810 the printing continuous sheet number Ma actually measured and the predetermined continuous sheet number Mc are compared with each other via the continuous sheet comparison circuit.

When the printing continuous sheet number Ma actually measured is greater than the predetermined continuous sheet number Mc (Ma>Mc), the predetermined ΔcT is subtracted from the initial set temperature Tm0 of the intermediate heating area (Tm0−ΔcT) in act A811, and then the process proceeds to operation A812.

On the other hand, when the printing continuous sheet number Ma actually measured is equal to or less than the predetermined continuous sheet number Mc (Ma≤Mc), the initial set temperature Tm0 is maintained and then the process proceeds to operation A812.

Accordingly, the temperature output from the intermediate heating area temperature setting unit 66 is any of four temperatures which are Tm0, Tm0+ΔeT, Tm0−ΔcT, and Tm0+ΔeT−ΔcT according to the magnitudes of the actually measured surrounding temperature Ta and the set temperature Ts and the amounts of the actually measured printing continuous sheet number Ma and the predetermined printing continuous sheet number Mc (See, operation A812).

The output signal according to the temperature setting is input from the intermediate heating area temperature setting unit 66 to the intermediate heating area frequency control unit 67. At operation A813 the opening and the closing of the switches R1 to Rj−1, Rk+1 to Rn of the intermediate temperature area is controlled by frequency according to the temperature.

On the other hand, at operation A814, the heating temperature Th set at the printing area temperature setting unit 61 is input to the printing area frequency control unit 62 and thus the opening and closing of the switches Rj to Rk of the printing area is controlled by the predetermined frequency. The print width is changed per page, and in some embodiments, when the printing area is changed the intermediate heating area also is changed.

At operation A815 the image data included in the image information described above is printed at the printer unit 17. The toner on the paper is heated and fixed in the fixing device and the paper subjected to the fixing processing is discharged from the paper discharging portion 38.

Modification Example and Application Example

Until the fixing process is started at the fixing device 36 the heating area of the paper on which the toner is attached may have a set heating temperature Th and the intermediate heating area may have a corrected temperature value of Tm0.

As such, prior to the fixing processing, acquisition of the image information including the image data via scanning the document described above, and printing in the printer unit 17 by the image data may be done in parallel with preparation for the fixing process. In other words, by way of example only, preparation for fixing, as described above, may be performed after the toner of each color is primarily transferred to the intermediate transfer belt 21 and then from the intermediate transfer belt 21 to the paper P, when the paper to which the toner image is attached is transported to the fixing device 36.

Benefits of the present disclosure include a fixing device and an image forming apparatus which have minimal effects on printing onto paper and can efficiently operate.

Further, in the embodiments described above, an example in which the set temperature of the intermediate heating area is changed by the surrounding temperature and the printing continuous sheet number has been described. According to such embodiments, the temperature of the intermediate heating area can be a more appropriate heating temperature, an improved printing quality is obtained, and a printed product in which paper wrinkling and/or destruction is unlikely to be generated.

However, in certain embodiments, any one or both of the surrounding temperature and the printing continuous sheet number might not be detected.

Further, in certain embodiments, the print width may be the maximum print width. However, in other embodiments, the print width may be the average print width. Additionally, in other embodiments, the print width of the image data is determined by one page. However, the print width of the image data may also be measured by at least two pages and/or by several lines within the one page such that the width is changed.

In other embodiments, the switch may be controlled by AC. However, the switch may be controlled by a voltage pulse of predetermined width. In this case, with regard to the pulse width at which the switch turns on in the print heating area, it is possible to adjust the heating temperature by the pulse width thereof being narrowed or widened in the intermediate heating area. The switch is not necessarily a simple switch for opening and closing, and, in fact, the switch may be an element having a switching function.

In other embodiments, a heating element other than a resistor may be used. For example, the heating member may include a radiant energy source.

In addition, in other embodiments, and at operation A812, the initial value Tm0 of the intermediate heating area temperature set may be corrected in accordance with the predetermined surrounding temperature Ta or the predetermined printing continuous sheet number Ma to be re-set to the new set temperature (Tm0+ΔeT−ΔcT).

By way of example only, if the set temperature Tm0 itself does not change, the actual temperature of the intermediate heating area is increased due to an increase of the printing continuous sheet number in the middle of the printing which may be detected by the temperature detecting member 362. Furthermore, the control signal for controlling the actual temperature to approach the set initial value Tm0 by removing this increase is sent to the intermediate heating area frequency control unit 67.

As shown in FIG. 4 above, the toner is heated and fixed on the paper P which is moved between the endless belt 363 and the press roller 366 by the heating unit side of the heating member 361 which is in contact with the inner side of the endless belt 363 and pressed in the direction of the press roller 366 facing the heating unit side of the heating member. The endless belt 363 is driven by the belt transport roller 364 which is operatively connected to the drive motor. However, the endless belt may be driven from the press roller side, and as such, it is also possible to transfer the paper P.

Figure 9:
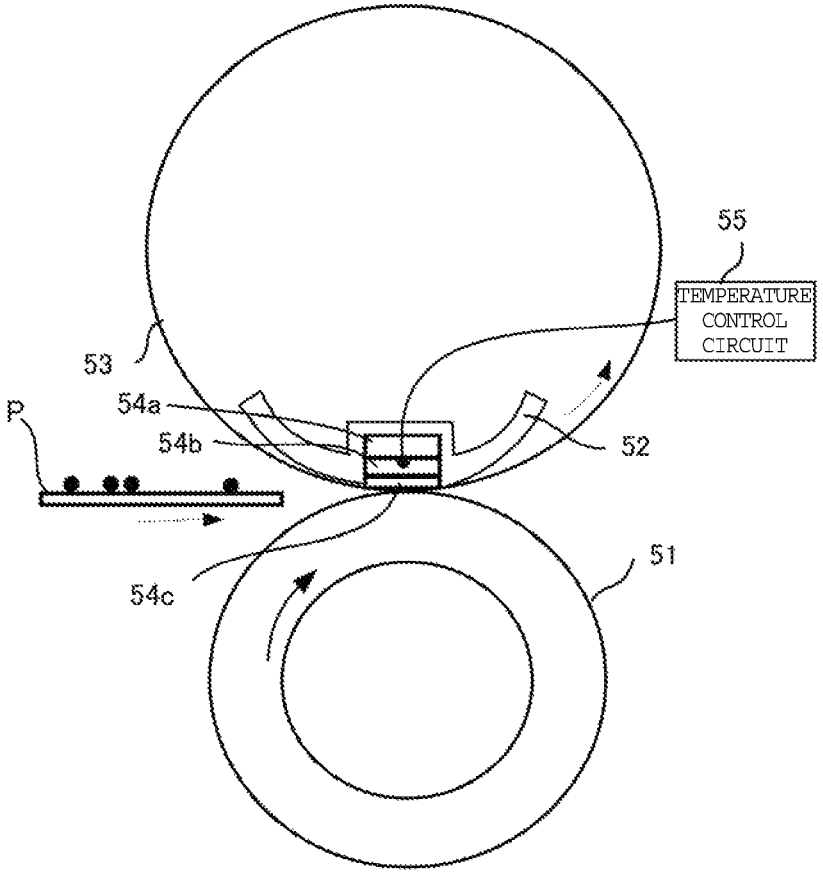
FIG. 9 is a schematic view illustrating a construction of a fixing device, according to one embodiment described herein.

FIG. 9 schematically illustrates a fixing device. As shown, the fixing device of FIG. 9 is driven from the press roller side. A film guide 52 having an arc-shaped cross section is disposed opposite the press roller 51. Furthermore, a fixing film 53 is rotatably attached on the outside of the film guide. A ceramic heater 54*a*, a plurality of heating members 54*b*, and a protective layer 54*c* are each provided on the inside the film guide 52 in a stacked manner. The stacked portion is in pressure contact with the press roller via the fixing film to form a nip portion. The heating members, as described above, are operatively connected in parallel with each other and are connected to a temperature control circuit 55. The temperature control circuit 55 controls the temperature by controlling the opening and the closing of a switching element (not illustrated).

During operation of the fixing device, the press roller 51 which is operatively connected to the driving motor is driven and rotated, and the fixing film 53 being in contact with the press roller is also driven and rotated. The paper P is disposed between the fixing film 53 and the press roller 51 from the left side, is heated and fixed by the heating members 54*b*, and is discharged to the right side.

As such, the fixing device may also have a structure applying a driving force from the press roller side.

While certain embodiments have been described these embodiments have been presented by way of example only, and are not intended to limit the scope of the inventions. Indeed, the novel apparatus and methods described herein may be embodied in a variety of other forms: furthermore various omissions, substitutions and changes in the form of the apparatus and methods described herein may be made without departing from the spirit of the inventions. The accompanying claims and there equivalents are intended to cover such forms of modifications as would fall within the scope and spirit of the invention.

What is claimed is:

1. A fixing device, comprising:

a plurality of heating members each contacting an inside of a rotating body, the rotating body having an endless shape and extending in a direction perpendicular to a direction of rotation of the rotating body with a width equal to or greater than a width of a recording medium to be printed;

a press roller disposed on an outside of the rotating body and corresponding to the plurality of heating members, wherein the press roller is configured to be in pressure contact with the recording medium, and wherein the recording medium passes between the rotating body and the press roller during printing thereof;

an intermediate temperature control unit having a medium width detecting unit configured to detect a width of the recording medium and a print width detecting unit configured to detect a print width of recording data, wherein the intermediate temperature control unit is configured to compare the width of the recording medium detected by the medium width detecting unit and the print width of the recording data detected by the print width detecting unit, and wherein the intermediate temperature control unit is further configured to control a portion of one of the heating members corresponding to an intermediate heating area positioned inside an area of the recording medium and outside a recording data area, wherein the intermediate heating area is maintained at a set intermediate temperature which is lower than a set temperature of a printing heating area; and a temperature detecting unit configured to detect a surrounding temperature, wherein the intermediate temperature control unit is configured to output a signal for increasing heat generated by the heating member when the temperature detected by the temperature detecting unit is lower than a predetermined temperature.

2. The fixing device of claim 1, further comprising:

a continuous printing sheet number detection unit configured to detect a continuous printing sheet number when the recording medium is continuously printed, wherein the intermediate temperature control unit is configured to output a signal for decreasing the heat generated by the heating member when the continuous printing sheet number reaches a predetermined sheet number.

3. The fixing device of claim 1, further comprising:

a plurality of switches connected to a power source and corresponding to the plurality of heating members, respectively, wherein each switch is openable and closeable, and wherein the intermediate temperature control unit is configured to turn off a switch operatively connected to one of the heating members in an area which is outside the width of the recording medium and inside the width of the plurality of heating members disposed in parallel.

4. An image forming apparatus, comprising:

an image forming unit configured to form a toner image by attaching toner to an electrostatic latent image;

an image transfer unit configured to transfer the toner image formed by the image forming unit to a recording medium;

a plurality of heating members in contact with an inside of a rotating body having a circular shape, wherein the rotating body is in contact with the recording medium to which the toner image is transferred by the image transfer unit, and wherein the recording medium extends in a direction perpendicular to a rotation direction of the rotating body with a width equal to or greater than a width of the recording medium to be printed;

a press roller disposed on an outside of the rotating body and configured to correspond to the plurality of heating members, wherein the press roller is configured to be in pressure contact with the recording medium which passes between the rotating body and the press roller;

an intermediate temperature control unit having a medium width detecting unit configured to detect a width of the recording medium and a print width detecting unit configured to detect a print width of recording data, wherein the intermediate temperature control unit is configured to compare the width of the recording medium detected by the medium width detecting unit and the print width of the recording data detected by the print width detecting unit, and wherein the intermediate temperature control unit is further configured to control a portion of the heating member corresponding to an intermediate heating area positioned inside an area of the recording medium and outside a recording data area, wherein the intermediate heating area is maintained at a set intermediate temperature which is lower than a set temperature of the printing heating area;

a discharging unit configured to discharge the recording medium on which the toner is fixed by passing through between the press roller and the rotating body; and a continuous printing sheet number detection unit configured to detect a continuous printing sheet number when the recording medium is continuously printed, wherein the intermediate temperature control unit is configured to output a signal for decreasing the heat generated by the heating member when the continuous printing sheet number reaches a predetermined sheet number.

5. The fixing device of claim 4, further comprising:

a plurality of switches connected to a power source and corresponding to the plurality of heating members, respectively, wherein each switch is openable and closeable, and wherein the intermediate temperature control unit is configured to turn off a switch operatively connected to one of the heating members in an area which is outside the width of the recording medium and inside the width of the plurality of heating members disposed in parallel.

6. A fixing device, comprising:

a rotating body;

a plurality of heating members each contacting an inside of the rotating body, a press roller disposed on an outside of the rotating body which corresponds to the plurality of heating members; and an intermediate temperature control unit, comprising:

a medium width detecting unit configured to detect a width of the recording medium; and a print width detecting unit configured to detect a print width of recording data, wherein the intermediate temperature control unit is configured to compare the width of the recording medium detected by the medium width detecting unit and the print width of the recording data detected by the print width detecting unit, wherein the intermediate temperature control unit is further configured to control a portion of the heating member corresponding to an intermediate heating area positioned inside an area of the recording medium and outside a recording data area, and wherein the intermediate heating area is maintained at a set intermediate temperature which is lower than a set temperature of a printing heating area;

a plurality of switches connected to a power source and corresponding to the plurality of heating members; and a temperature detecting unit configured to detect a surrounding temperature, wherein the intermediate temperature control unit is configured to output a signal for increasing heat generated by the heating member when the temperature detected by the temperature detecting unit is lower than a predetermined temperature.

7. The fixing device of claim 6, wherein each switch is openable and closeable.

8. The fixing device of claim 6, wherein the intermediate temperature control unit is configured to turn off at least one switch operatively connected to one of the heating members in an area which is outside the width of the recording medium and is inside the width of the plurality of heating members disposed in parallel.

9. The fixing device of claim 6, wherein the rotating body has a round shape and extends in a direction perpendicular to a direction of rotation of the rotating body with a width which is equal to or greater than a width of a recording medium to be printed.

10. The fixing device of claim 6, wherein the press roller is in pressure contact with a recording medium.

11. The fixing device of claim 10, wherein the recording medium is configured to pass between the rotating body and the press roller.

12. The fixing device of claim 6, wherein each heating member includes a heating resistor, and each switch is configured to change a temperature of at least one heating resistor operatively connected to the switch by changing a switching frequency of the switches.

13. The fixing device of claim 6, wherein the rotating body is a belt, and further comprising:

a belt transport roller operatively connected to the belt and configured to drive the belt; and a tension roller operatively connected to the belt and configured to apply tension to the belt.

14. The fixing device of claim 13, wherein at least one side of each heating member is configured to generate heat, and the at least one side of each heating member is in contact with an inside of the belt.

15. The fixing device of claim 13, wherein each heating member is plate shaped.

16. The fixing device of claim 13, wherein the belt comprises an elastic layer stretched by a plurality of rollers.

17. The fixing device of claim 13, wherein the plurality of heating members forms a fixing nip between the belt and the press roller.

18. The fixing device of claim 13, wherein each heating member includes a heating resistor.

19. The fixing device of claim 18, wherein the heating resistors are operatively connected in parallel with each other.

20. The fixing device of claim 18, wherein at least one switch is operatively connected to each heating resistor.

* * * * *